United States Patent [19]

Akase et al.

[11] 4,160,190

[45] Jul. 3, 1979

[54] CIRCUIT COMPRISING AN AIR GAP FOR DRIVING A LASER

[75] Inventors: Kazutoyo Akase; Isao Kobayashi, both of Tokyo, Japan

[73] Assignee: Nippon Electric Co., Ltd., Tokyo, Japan

[21] Appl. No.: 838,836

[22] Filed: Oct. 3, 1977

[51] Int. Cl.[2] ..... H05B 41/32

[52] U.S. Cl. ..... 315/168; 315/203; 315/241 R; 315/335; 331/94.5 P

[58] Field of Search ..... 315/241 R, 233, 335, 315/337, 168, 203; 331/94.5 P

[56] References Cited

U.S. PATENT DOCUMENTS

| | | | |
|---|---|---|---|
| 2,953,721 | 9/1960 | Chauvineau | 315/241 R |
| 3,430,159 | 2/1969 | Roeber | 315/241 R |

FOREIGN PATENT DOCUMENTS

| | | | |
|---|---|---|---|
| 1121617 | 5/1956 | France | 315/335 |

*Primary Examiner*—Eugene R. LaRoche

*Attorney, Agent, or Firm*—Hopgood, Calimafde, Kalil, Blaustein & Lieberman

[57] ABSTRACT

In a driving circuit which is used together with a flash lamp supplied with an exciting voltage and which comprises a transformer responsive to a trigger pulse for developing a pulse voltage and an exciting member around the lamp for causing a discharge to occur in the lamp in response to the pulse voltage to energize a laser device placed adjacent the lamp, a control member disposed between the transformer and the exciting member allows the pulse voltage to be applied across the lamp and suppresses a parasitic voltage which is otherwise developed across the transformer as a result of the discharge. The control member may comprise an air gap that is preferably from one to several millimeters long.

2 Claims, 3 Drawing Figures

CIRCUIT COMPRISING AN AIR GAP FOR DRIVING A LASER

BACKGROUND OF THE INVENTION

This invention relates to a driving circuit, used together with a flash lamp supplied with an exciting voltage, for energizing a laser device in response to a trigger pulse.

A driving circuit for energizing a laser device, which may be a solid-state laser device comprises a discharge source circuit and a trigger circuit and is used together with a flash lamp having a pair of discharge electrodes and disposed adjacent to the laser device. The discharge source circuit is to be connected to the electrodes so as to supply an exciting voltage thereacross. The trigger circuit comprises a trigger pulse source for producing a trigger pulse, a transformer for developing a high voltage pulse across a pair of output terminals thereof in response to the trigger pulse, and an exciting member disposed so as to surround the lamp and to be connected to one of the lamp electrodes for causing a discharge to occur between the electrodes in response to the voltage pulse. The laser device is energized by the discharge to produce a pulse laser beam.

As will later be described with reference to one of a few figures of the accompanying drawing, a conventional driving circuit of the type described allows an inevitable self-flashing, or a parasitic discharge, to occur in the lamp due to a parasitic voltage developed across the output terminals as a result of the discharge. To suppress the parasitic voltage, an alternative conventional driving circuit is provided with an expensive element, such as an ignitron, in the discharge source circuit as will also later be described with reference to another figure of the accompanying drawing. The switching element is controlled by a complicated control circuit. This renders the driving circuit more expensive.

SUMMARY OF THE INVENTION

It is therefore an object of this invention to provide an inexpensive driving circuit, used for energizing a laser device together with a flash lamp, which is capable of suppressing an undesired parasitic discharge of the lamp.

It is another object of this invention to provide a driving circuit of the type described, wherein a trigger pulse effectively causes a desired discharge to occur in the lamp without any inconvenience.

It is a further object of this invention to provide a driving circuit of the type described, wherein electric insulation is sufficient between a discharge source circuit and a trigger circuit of the driving circuit even when a cooling medium is interposed between the source and trigger circuits.

A driving circuit to which this invention is applicable is used together with a flash lamp comprising a pair of discharge electrodes and supplied with an exciting voltage to energize a laser device placed adjacent to the lamp in response to a trigger pulse. The driving circuit comprises a transformer having a pair of output terminals, means for supplying the trigger pulse to the transformer to develop a pulse voltage across the output terminals, means for connecting one of the output terminals to one of the discharge electrodes, exciting means connected to the other of the output terminals and to be placed outwardly of the lamp for causing a discharge for energizing the laser device to occur in the flash lamp in response to the pulse voltage, and suppress means for preventing a parasitic voltage from being developed across the output terminals as a result of the discharge. According to this invention, the suppress means comprises control means between the exciting means and the other output terminal for allowing the pulse voltage to pass therethrough and preventing the parasitic voltage from being supplied from the other output terminal to the exciting means.

DESCRIPTION OF THE PREFERRED EMBODIMENTS

Figure 1:
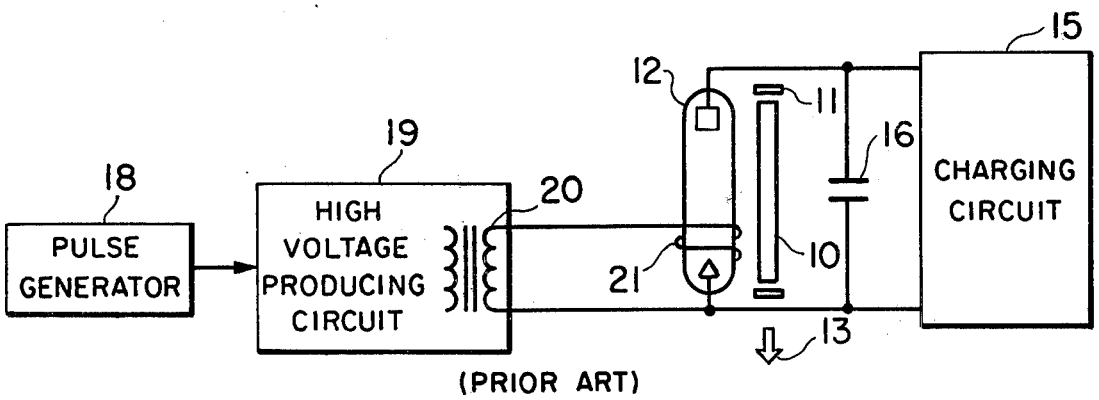
(PRIOR ART) FIG. 1
FIG. 1 is a schematic view of a conventional driving circuit together with a flash lamp used to put the circuit into operation and with a laser device to be energized by the circuit in cooperation with the lamp.

Referring to FIG. 1, a conventional driving circuit for energizing a laser device will be described at first for a better understanding of this invention. The laser device comprises an elongate laser medium 10 and an optical resonator 11 comprising, in turn, a pair of reflectors on both longitudinal sides of the medium 10. The laser medium 10 may be of ruby, yttrium aluminum garnet, glass, and so forth so that the laser device may be a solid-state laser device. The driving circuit is used together with a flash lamp 12 disposed adjacent to the laser device 10 and having a bulb and a pair of electrodes enclosed therewith. Preferably, the flash lamp is a xenon lamp. Responsive to a pulse voltage, the driving circuit causes a discharge to occur between the electrodes in the manner later described. The discharge excites the laser medium 10. The laser device is thus energized to emit a pulse laser beam 13. Preferably, the laser medium 10 and the flash lamp 12 are located inside a cylindrical or elliptical reflector (not shown) to effectively utilize the discharge in energizing the laser device, with at least the laser device and the lamp immersed in water or a like cooling medium. The driving circuit comprises a discharge source circuit and a trigger circuit. The discharge source circuit comprises a charging circuit 15 to be connected to the electrode pair of the flash lamp 12 and a charging capacitor 16 for supplying an exciting voltage of, for example, six kilovolts, across the electrode pair. The trigger circuit comprises a trigger pulse generator 18 for producing a trigger pulse and a high voltage producing circuit 19 comprising, in turn, a transformer 20 for developing a high pulse voltage across a pair of output terminals thereof. One of the output terminals is to be connected to one of the discharge electrodes directly through a conductive line. The trigger circuit further comprises an exciting member 21 disposed so as to helically surround the lamp 12 in the cooling medium, if the latter is used. The exciting member 21 is connected to the other output terminal to cause the discharge to occur in response to the pulse voltage.

When the discharge takes place in the flash lamp 12, a leakage voltage appears in the exciting member 21. This is particularly the case when use is made of the cooling medium which is generally insufficiently nonconductive. The leakage voltage causes an impulse current to flow from the exciting member 21 between the output terminal through the transformer 20. As a result, a parasitic or undesired high voltage is induced in the exciting member 21. The parasitic voltage often causes self-flashing or a parasitic discharge to occur in the flash lamp 12. Laser oscillation in the laser device 10 is therefore rendered unstable.

Figure 2:
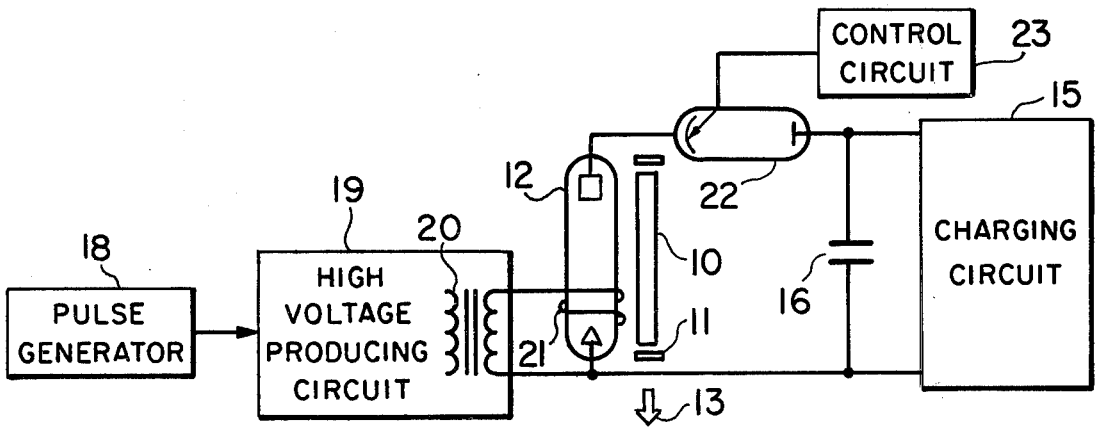
FIG. 2 (PRIOR ART)
FIG. 2 is a like schematic view of another conventional driving circuit of the type described.

Referring to FIG. 2, an alternative conventional device comprises a switching element 22 such as an ignitron, in the discharge source circuit to prevent the parasitic discharge from taking place. The switching element 22 is controlled by a control circuit 23 so that the exciting voltage from the discharge source circuit is not supplied across the electrode pair of the flash lamp 12 until reception of the pulse voltage from the transformer 20. This device is defective in that an expensive switching element 22 and a complicated control circuit 23 are necessary as pointed out in the preamble of the instant specification.

Figure 3:
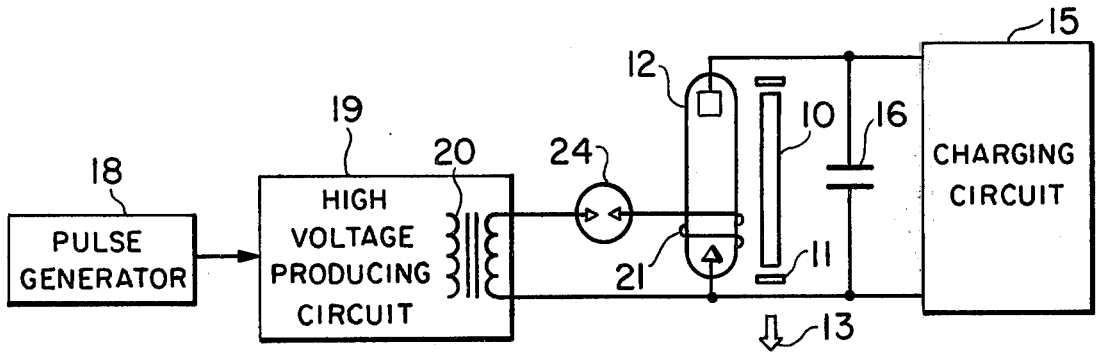
FIG. 3 is a similar schematic view of a driving circuit of the type described according to a preferred embodiment of this invention.

Referring now to FIG. 3, a driving circuit according to a preferred embodiment of this invention is for driving or energizing a laser device which comprises a laser medium 10 and an optical resonator 11 as described. The circuit is for use together with a flash lamp 12 having a pair of discharge electrodes and placed adjacent to the lamp device. Like the conventional driving circuit illustrated with reference to FIG. 1, a discharge source circuit is adapted to direct connection to the electrodes of the flash lamp 12. The discharge source circuit does not comprise a switching element 22 described in conjunction with the alternative conventional driving circuit shown in FIG. 2. The driving circuit according to the preferred embodiment further comprises a trigger circuit comprising, in turn, a pulse generator 18 for generating a trigger pulse whenever desired, a high voltage producing circuit 19 including a transformer 20 for developing a pulse voltage across a pair of output terminals thereof in response to the trigger pulse, and an exciting member 21 connected to one of the output terminals, like the conventional trigger circuits illustrated with reference to FIGS. 1 and 2. The trigger circuit further comprises a control member 24 between the exciting member 21 and the other of output terminals. Preferably, the control member 24 comprises a narrow air gap. The air gap, for example, one through several millimeters long is enough to allow the high pulse voltage, for example, of from 20 to 30 kilovolts, to pass therethrough and to prevent a parasitic voltage from taking place in the exciting member 21 in response to the discharge even when use is made of a cooling medium around the laser device and the flash lamp 12.

In operation, the control member 24 intercepts an impulse leak current flowing from the discharge source circuit to the transformer 20 to thereby prevent the parasitic discharge voltage from appearing across the transformer output terminals. The driving circuit according to this invention is therefore capable of avoiding an undesired self-flashing of the flash lamp 12 due to the parasitic voltage. When supplied with the pulse voltage from the transformer 20, the control member 24 readily yields to supply the pulse voltage to the exciting member 21 therethrough because the pulse voltage is higher than the parasitic discharge voltage. The exciting member 24 therefore allows only a desired discharge to occur in the flash lamp 12 without any inconvenience.

Although depicted as a straight lamp, the flash lamp 12 may be of a helical type surrounding the laser medium 10. Self-flashing more often occurs in the helical flash lamp. This invention is therefore more effective for use together with a helical flash lamp. The exciting member 21 is usually a metal wire disposed so as to helically surround the flash lamp 12 when the lamp 12 is put in place. When a metallic reflecting cylinder is used around the laser device and the flash lamp 12, the exciting member 24 may be a metallic plate surrounding at least partially the lamp 12. It is possible to provide the air gap serving as the control member 24 by a pair of opposing conductors of any material because the conductors are supplied only with a small electric power and scarcely damaged by repeated passage therethrough of the pulse voltage. Preferred material, however, is tungsten or stainless steel. Finally, use may be made as the control member 24 of either a vacuum spark gap or a spark gap sealed in an inactive gas. Alternatively, use is possible of a diode, which is turned on and substantially off in compliance with the voltage applied thereacross by the pulse and the parasitic voltages.

What is claimed is:

1. In a driving circuit used together with a flash lamp comprising a pair of discharge electrodes and supplied with an exciting voltage, said circuit being for energizing a laser device placed adjacent to said lamp in response to a trigger pulse and comprising a transformer having a pair of output terminals, means for supplying said trigger pulse to said transformer to develop a pulse voltage across said output terminals, means for connecting one of said output terminals to one of said discharge electrodes, exciting means connected to the other of said output terminals and to be placed outwardly of said lamp for causing a discharge for energizing said laser device to occur in said flash lamp in response to said pulse voltage, and suppress means for preventing a parasitic voltage from being developed across said output terminals as a result of said discharge, the improvement wherein said suppress means comprises a pair of conductors connected to said exciting means and said other output terminal, said conductor pair opposing each other with an air gap therebetween, said air gap being capable of allowing said pulse voltage to pass therethrough and preventing said parasitic voltage from being supplied from said other output terminal to said exciting means.

2. A driving circuit as claimed in claim 1, wherein said air gap is between one through several millimeters long.

* * * * *